US008829881B2

(12) United States Patent
Lin

(10) Patent No.: US 8,829,881 B2
(45) Date of Patent: Sep. 9, 2014

(54) REFERENCE CURRENT GENERATION CIRCUIT

(75) Inventor: Yu-Chuan Lin, Taipei (TW)

(73) Assignee: ASMedia Technology Inc., New Taipei (TW)

( * ) Notice: Subject to any disclaimer, the term of this patent is extended or adjusted under 35 U.S.C. 154(b) by 210 days.

(21) Appl. No.: 13/585,797

(22) Filed: Aug. 14, 2012

(65) Prior Publication Data

US 2013/0043848 A1 Feb. 21, 2013

(30) Foreign Application Priority Data

Aug. 18, 2011 (CN) ..... 2011 1 0237228

(51) Int. Cl.
*G05F 3/04* (2006.01)
*G05F 1/56* (2006.01)

(52) U.S. Cl.
CPC ..... *G05F 1/561* (2013.01)
USPC ..... 323/312; 323/299; 327/538

(58) Field of Classification Search
USPC ..... 323/311–314, 273, 299; 327/538, 539, 327/543
See application file for complete search history.

(56) References Cited

U.S. PATENT DOCUMENTS

| | | | | |
|---|---|---|---|---|
| 7,737,675 | B2 * | 6/2010 | Murase | 323/314 |
| 2008/0303498 | A1 | 12/2008 | Huang | |
| 2010/0060345 | A1 | 3/2010 | Huang et al. | |
| 2010/0315060 | A1 * | 12/2010 | Ikeda et al. | 323/314 |

* cited by examiner

*Primary Examiner* — Gary L Laxton
*Assistant Examiner* — Afework Demisse
(74) *Attorney, Agent, or Firm* — Jianq Chyun IP Office

(57) ABSTRACT

A reference current generation circuit is provided, in which a current generated according to a bandgap voltage is not directly used as a reference current, but the current generated according to the bandgap voltage is used to adjust an output reference current. In this way, the reference voltage is generated without using an external resistor, so as to effectively decrease the production cost.

15 Claims, 6 Drawing Sheets

REFERENCE CURRENT GENERATION CIRCUIT

CROSS-REFERENCE TO RELATED APPLICATION

This application claims the priority benefit of China application serial no. 201110237228.9, filed on Aug. 18, 2011. The entirety of the above-mentioned patent application is hereby incorporated by reference herein and made a part of this specification.

BACKGROUND OF THE INVENTION

1. Field of the Invention

The invention relates to a reference current generation technique. Particularly, the invention relates to a reference current generation circuit suitable for applying in a chip.

2. Description of Related Art

FIG. 1 is a schematic diagram of a conventional current source circuit. Referring to FIG. 1, the conventional current source circuit 100 includes a bandgap voltage generator 102, an operational amplifier 104, an external resistor Rext, an N-type transistor M1 and P-type transistors Q1-Q3. A positive input terminal of the operational amplifier 104 is coupled to the bandgap voltage generator 102, a negative input terminal thereof is coupled to a source of the N-type transistor M1, and an output terminal of the operational amplifier 104 is coupled to a gate of the N-type transistor M1. The external resistor Rext is coupled between the source of the N-type transistor M1 and ground. Moreover, a gate of the P-type transistor Q1 is coupled to a drain thereof, the drain of the P-type transistor Q1 is coupled to a drain of the N-type transistor M1, and a source of the P-type transistor Q1 is coupled to a power voltage VDD. In addition, gates of the P-type transistors Q2 and Q3 are coupled to the gate of the P-type transistor Q1, and sources of the P-type transistors Q2 and Q3 are coupled to the power voltage VDD.

As shown in FIG. 1, when a reference current non-related to temperature, process and reference voltage is required to be generated in internal of a chip, according to a conventional method, the bandgap voltage generator 102 is used to generate an accurate reference voltage VBG, and the operational amplifier 104 duplicates such voltage to the external resistor Rext of the chip through a negative feedback manner, so as to generate the required reference current on the channel of the P-type transistor Q1. The P-type transistors Q2 and Q3 are used to duplicate the reference current flowing through the P-type transistor Q1, and output the duplicated reference current through the drains thereof. Although the accurate reference current can be generated according to the conventional technique, external pins of the chip have to be increased, and the external resistor Rext occupies a large space, which may increase a manufacturing cost, and is not economic effective.

SUMMARY OF THE INVENTION

The disclosure provides a reference current generation circuit including a reference voltage generation unit, an operating current generation unit, a comparison module, an adjustment module and a first output stage. The reference voltage generation unit is configured to generate a reference voltage and a comparison voltage. The operating current generation unit receives the reference voltage to generate a first operating current and a second operating current. The comparison module generates an output voltage according to the reference voltage, the first operating current and the second operating current, and compares the output voltage with the comparison voltage to generate a comparison signal for outputting. The adjustment module receives the comparison signal to generate a first enable signal and an adjusting current. The first output stage receives the adjusting current, the first enable signal and the second operating current, and outputs a first reference current.

According to the above descriptions, in the disclosure, the reference current is not directly generated based on the bandgap voltage, but the comparison module, the adjustment module and the output stage are used to adjust the reference current according to the operating current (which is generated according to the bandgap voltage), by which the reference voltage is generated without using an external resistor, so as to effectively decrease the production cost.

In order to make the aforementioned and other features and advantages of the disclosure comprehensible, several exemplary embodiments accompanied with figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DETAILED DESCRIPTION OF DISCLOSED EMBODIMENTS

Figure 1:
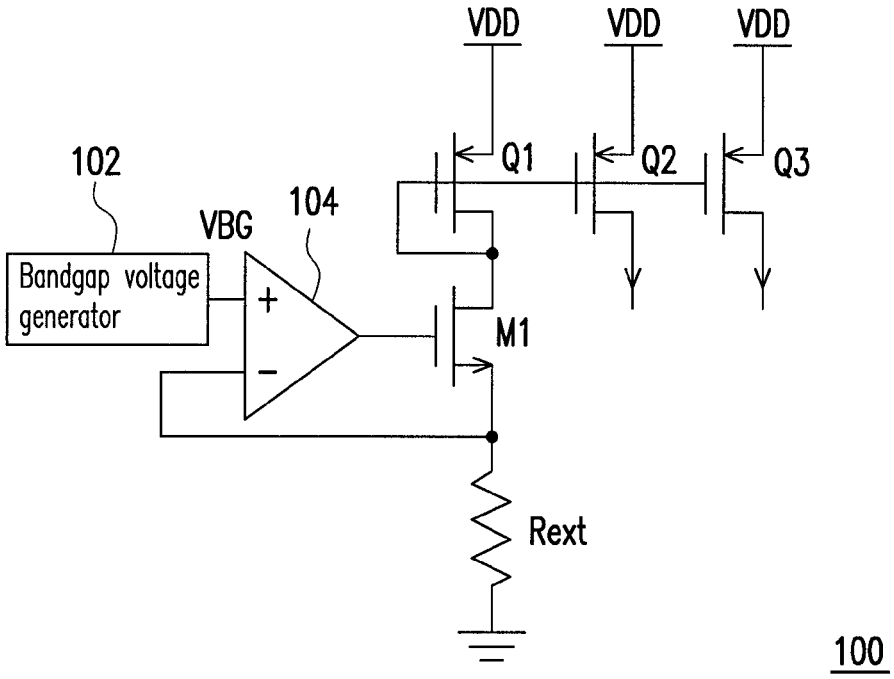
FIG. 1 is a schematic diagram of a conventional current source circuit.
Figure 2:
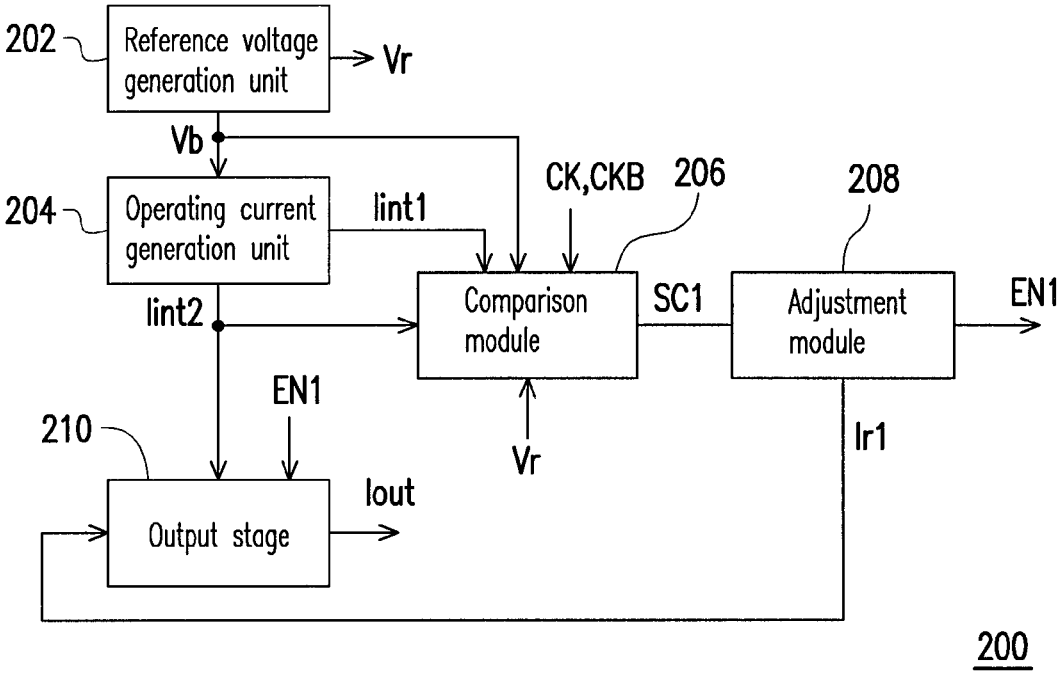
FIG. 2 is a schematic diagram of a reference current generation circuit according to a first embodiment of the disclosure.

FIG. 2 is a schematic diagram of a reference current generation circuit according to a first embodiment of the disclosure. Referring to FIG. 2, the reference current generation circuit 200 includes a reference voltage generation unit 202, an operating current generation unit 204, a comparison module 206, an adjustment module 208 and an output stage 210. The operating current generation unit 204 is coupled to the reference voltage generation unit 202, the comparison module 206 is coupled to the reference voltage generation unit 202, the operating current generation unit 204 and the adjustment module 208, and the output stage 210 is coupled to the operating current generation unit 204 and the adjustment module 208.

The reference voltage generation unit 202 is used to generate a reference voltage Vb and a comparison voltage Vr, the operating current generation unit 204 receives the reference voltage Vb, and generates an operating current lint1 and an operating current lint2, i.e. the operating current generation unit 204 generates the operating current lint1 and the operating current lint2 in response to the reference voltage Vb. The comparison module 206 generates an output voltage Vout (referring to FIG. 3, which is a voltage signal generated in internal of the comparison module 206) according to the reference voltage Vb, the operating current lint1 and the operating current lint2, and compares the output voltage Vout with the comparison voltage Vr to generate a comparison signal SC1. Further, the comparison module 206 compares the output voltage Vout with the comparison voltage Vr to generate the comparison signal SC1 in response to a clock signal CKB and a clock signal CK. The adjustment module 208 receives the comparison signal SC1 to generate an enable signal EN1 and an adjusting current Ir1. The output stage 210 receives the enable signal EN1, the operating current lint2 and the adjusting current Ir1, and outputs a reference current Iout, i.e. the output stage 210 outputs the reference current Tout in response to the enable signal EN1, wherein the reference current Iout correlated to the operating current lint2 and the adjusting current Ir1.

As described above, by adjusting a voltage value of the comparison voltage Vr, the adjusting current Ir1 output by the adjustment module 208 can be changed, so that the output stage 210 can generate the accurate reference current Iout. In this way, it is unnecessary to use an external resistor to adjust the reference current as that does in a conventional current source circuit, i.e. it is unnecessary to increase external pins of the chip, so that the production cost can be decreased.

Figure 3:
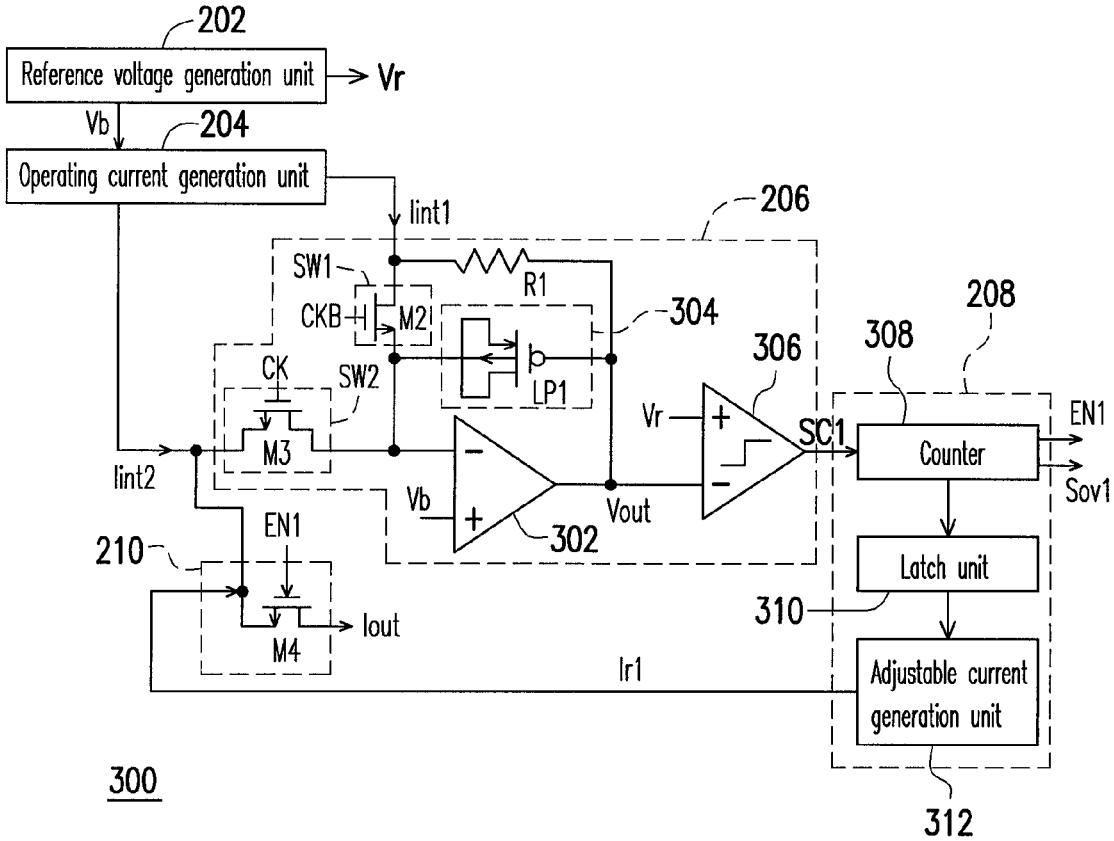
FIG. 3 is a detailed circuit diagram of the reference current generation circuit of FIG. 2.

FIG. 3 is a detailed circuit diagram of the reference current generation circuit of FIG. 2. Referring to FIG. 3, in the present embodiment, the reference voltage generation unit 202 is, for example, a bandgap voltage generation circuit, and the reference voltage Vb and the comparison voltage Vr are, for example, generated according to a bandgap voltage. The comparison module 206 includes an operational amplifier 302, a switch SW1, a switch SW2, a resistor R1, a capacitor element 304 and a comparator 306. A positive input terminal of the operational amplifier 302 is coupled to the reference voltage Vb, a negative input terminal of the operational amplifier 302 is coupled to one terminal of the switch SW2, and another terminal of the switch SW2 is coupled to the operating current generation unit 204. One terminal of the switch SW1 is coupled to the negative input terminal of the operational amplifier 302, and another terminal of the switch SW1 is coupled to the operating current generation unit 204. In the present embodiment, the switch SW1 and the switch SW2 are respectively implemented by an N-type transistor M2 and an N-type transistor M3, where a source of the N-type transistor M2 is coupled to the negative input terminal of the operational amplifier 302, a drain thereof is coupled to the operating current generation unit 204, and a gate of the N-type transistor M2 receives the clock signal CKB. A source of the N-type transistor M3 is coupled to the operating current generation unit 204, a drain thereof is coupled to the negative input terminal of the operational amplifier 302, and a gate of the N-type transistor M2 receives the clock signal CK.

One terminal of the resistor R1 is coupled to a common node of the switch SW1 and the operating current generation unit 204, and another terminal thereof is coupled to an output terminal of the operational amplifier 302. It should be noticed that if the reference current generation circuit 200 of the present embodiment is applied in internal of a chip, the resistor R1 can be a resistor in the internal of the chip other than an external resistor. The capacitor element 304 is coupled between the negative input terminal and the output terminal of the operational amplifier 302. In the present embodiment, the capacitor element 304 is composed of a P-type low voltage transistor LP1, where a gate of the P-type low voltage transistor LP1 is coupled to the output terminal of the operational amplifier 302, and a drain, a source and a bulk of the P-type low voltage transistor LP1 are coupled to the negative input terminal of the operational amplifier 302. Moreover, the output terminal of the operational amplifier 302 is further coupled to the negative input terminal of the comparator 306, a positive input terminal of the comparator 306 is coupled to the comparison voltage Vr, and an output terminal of the comparator 306 is coupled to the adjustment module 208.

Moreover, the adjustment module 208 includes a counter 308, a latch unit 310 and an adjustable current generation unit 312. The counter 308 is coupled to the comparator module 206 and the latch unit 310, and the adjustable current generation unit 312 is coupled to the latch unit 310 and the output stage 210. In the present embodiment, the output stage 210 is composed of an N-type transistor M4, where a source of the N-type transistor M4 is coupled to the operating current generation unit 204, a gate thereof receives the enable signal EN1, and a drain thereof outputs the reference current Iout.

Figure 4:
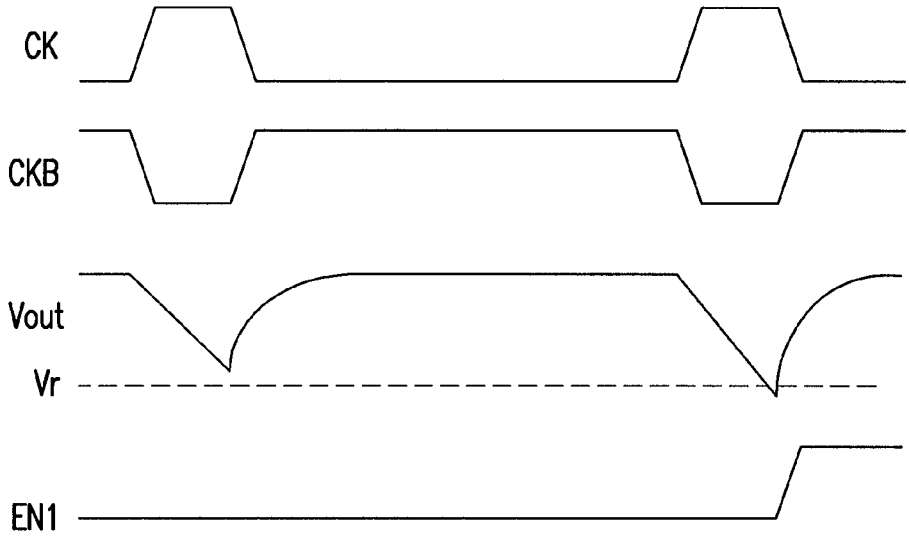
FIG. 4 is a waveform schematic diagram of a part of signals in the embodiment of FIG. 3.

FIG. 4 is a waveform schematic diagram of a part of signals in the embodiment of FIG. 3. Operations of the reference current generation circuit 300 are described below with reference of FIG. 3 and FIG. 4. When the clock signal CKB has a high voltage level and the clock signal CK has a low voltage level, the reference current generation circuit 300 is in a reset mode. Now, the switch SW1 is turned on, the switch SW2 is turned off, and a voltage on the negative input terminal of the operational amplifier 302 is clamped to the reference voltage Vb, and the operating current lint1 flows to the output terminal of the operational amplifier 302 through the resistor R1, so as to produce the output voltage Vout at the output terminal of the operational amplifier 302 to drive the capacitor element 304. The output voltage Vout of the output terminal of the operational amplifier 302 can be represented by a following equation:

$$Vout = Vb - lint1 \times R1 \quad (1)$$

Moreover, when the clock signal CKB has the low voltage level, and the clock signal CK has the high voltage level, the reference current generation circuit 300 is in a charge mode. Now, the switch SW1 is turned off, and the switch SW2 is turned on, and the voltage on the negative input terminal of the operational amplifier 302 is still clamped to the reference voltage Vb. Since the switch SW2 is turned on, the operating current lint2 charges the capacitor element 304 through the switch SW2. Since the voltage on the negative input terminal of the operational amplifier 302 is clamped to the reference voltage Vb, i.e. a voltage on a terminal of the capacitor element 304 is fixed to the reference voltage Vb, the operating current lint2 charges the capacitor element 304 to decrease a voltage (i.e. the output voltage Vout) at another terminal of the capacitor element 304. As shown in FIG. 4, when the clock signal CK is transited to the high voltage level, the output voltage Vout accordingly decreases, and the output voltage Vout stops decreasing until the clock signal CK is again transited, and the output voltage Vout slowly returns back to a voltage level as that when the reference current generation circuit 300 is in the reset mode.

On the other hand, the comparator 306 compares the output voltage Vout and the comparison voltage Vr, and outputs a comparison signal SC1 according to a comparison result. When the reference current generation circuit 300 is in the charge mode, if the output voltage Vout is greater than the comparison voltage Vr, the counter 308 accumulates a count value, and outputs the accumulated count value to the latch unit 310. The latch unit 310 temporarily stores the count value, and transmits the count value to the adjustable current generation unit 312 according to an operating clock signal of the reference current generation circuit 300. The adjustable current generation unit 312 outputs the adjusting current Ir1 according to the count value, where the greater the count value is, the greater the adjusting current Ir1 output by the adjustable current generation unit 312 is.

By using the clock signal CKB and the clock signal CK to repeatedly switch the reference current generation circuit 300, a charging current of the capacitor element 304 becomes greater, and a decreasing magnitude of the output voltage Vout becomes greater. When the output voltage Vout is decreased to be smaller than the comparison voltage Vr, the comparison signal SC1 output by the comparator 306 is transited, and now the counter 308 outputs the enable signal EN1 (i.e. pulls up the enable signal EN1 to the high voltage level) according to the comparison signal SC1. The output stage 210 outputs the reference current Iout according to the enable signal EN1, i.e. the N-type transistor M4 is turned on, and the drain thereof outputs the reference current Iout (including the operating current Iint2 and the adjusting current Ir1).

It should be noticed that in some embodiments, the counter 308 can be designed to output an overflow signal Sov1 when counting to a threshold value, so as to control the adjustable current generation unit 312 to increase a magnitude of each current adjustment, and accelerate a decreasing rate of the output voltage Vout, so that the output voltage Vout is lower than the comparison voltage Vr, which avoids delay in outputting the reference current Iout by the reference current generation circuit. Moreover, although the switch SW1, the switch SW2 and the output stage 210 of the aforementioned embodiment are all implemented by the N-type transistors, the disclosure is not limited thereto. In addition, the capacitor element 304 is not limited to be implemented by the P-type low voltage transistor, which can also be implemented by devices comprising the same function and characteristic in actual applications. For example, the capacitor element 304 can also be implemented by a capacitor.

Figure 5:
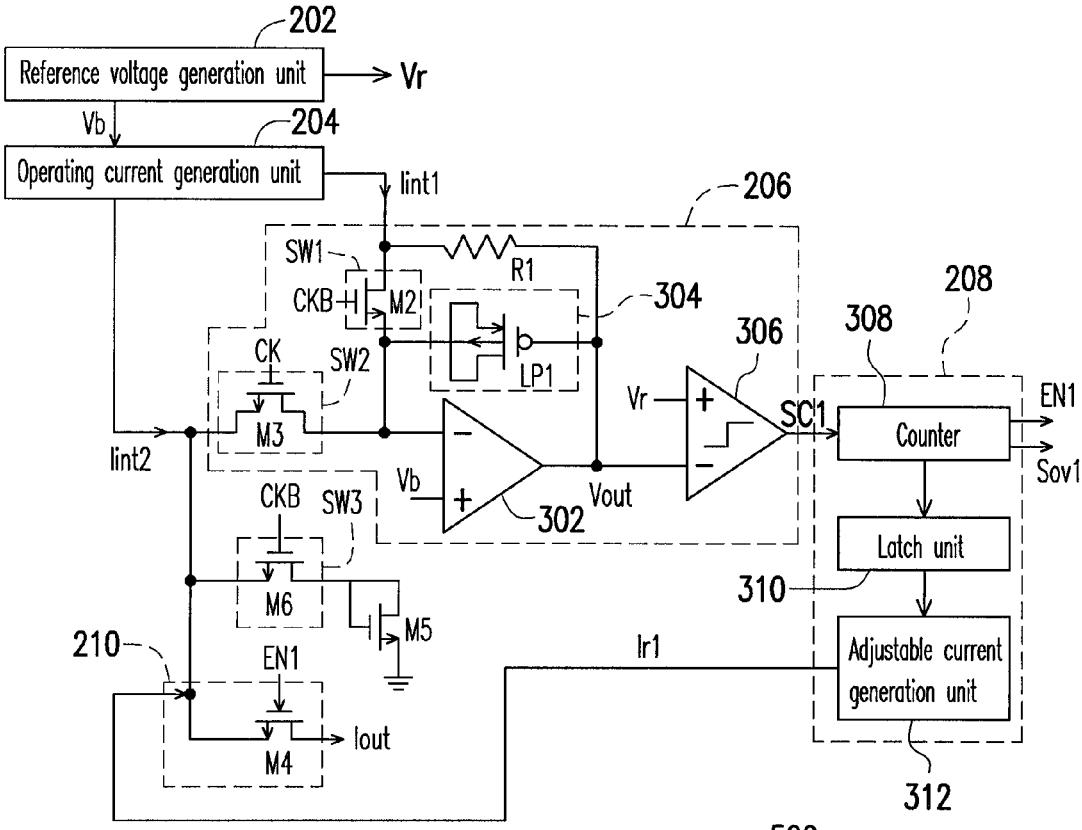
FIG. 5 is a schematic diagram of a reference current generation circuit according to a second embodiment of the disclosure.

FIG. 5 is a schematic diagram of a reference current generation circuit according to a second embodiment of the disclosure. Referring to FIG. 5, a difference between the reference current generation circuit 500 of the present embodiment and the reference current generation circuit 300 of FIG. 3 is that the reference current generation circuit 500 further includes a switch SW3 and an N-type transistor M5, where one terminal of the switch SW3 is coupled to the operating current generation unit 204, and another terminal thereof is coupled to a drain of the N-type transistor M5. A gate and the drain of the N-type transistor M5 are coupled to each other, and a source thereof is coupled to ground. In the present embodiment, the switch SW3 is composed of an N-type transistor M6, a source thereof is coupled to the operating current generation unit 204, a drain thereof is coupled to the drain of the N-type transistor M5, and a gate of the N-type transistor M6 receives the clock signal CKB.

A conduction state of the switch SW3 is controlled by the clock signal CKB. When the switch SW2 is turned off under control of the clock signal CK, the switch SW3 is turned on under control of the clock signal CKB, and the operating current Iint2 flows to the ground through the N-type transistors M6 and M6. In this way, when the switch SW2 is again turned on, a current recovery time of the switch SW2 is shortened.

Figure 6:
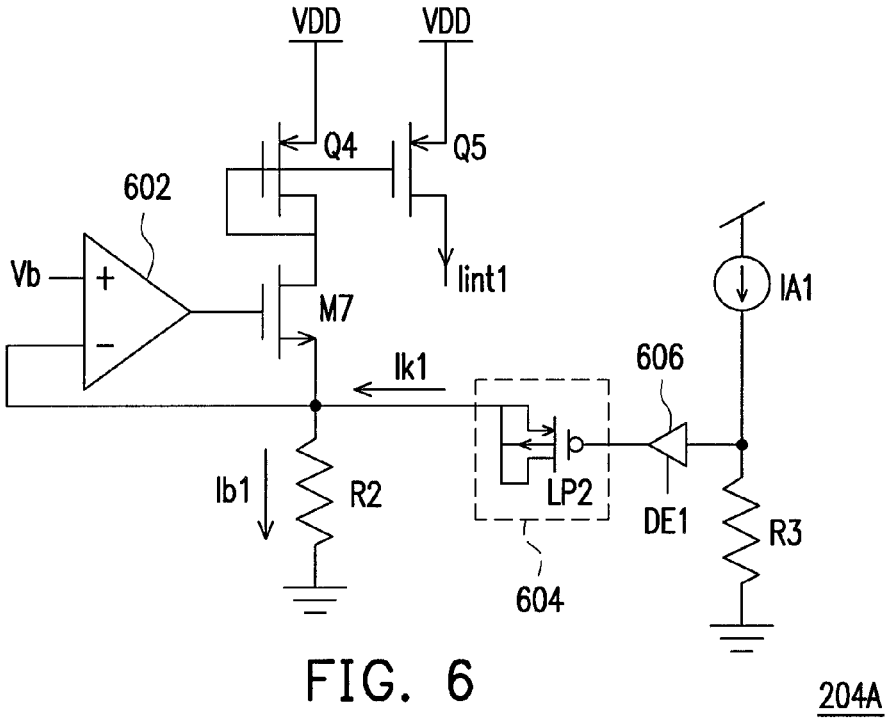
FIG. 6 is a schematic diagram of an operating current generation circuit according to the second embodiment of the disclosure.

In detail, in a general application, when the capacitor element 304 is charged/discharged, a leakage current effect is generated. In order to ensure that an accuracy of the reference current Iout generated by the reference current generation circuit is not influenced by the leakage current effect, the operating current generation unit 204 may include an operating current generation circuit 204A of FIG. 6, which is used to generate the operating current Iint1 capable of compensating the leakage current effect of the capacitor element 304. Referring to FIG. 6, the operating current generation circuit 204A includes an operational amplifier 602, resistors R2 and R3, an N-type transistor M7, P-type transistors Q4 and Q5, a capacitor element 604, a buffer 606 and a current source IA1. A positive input terminal of the operational amplifier 602 is, for example, coupled to a bandgap voltage generator for receiving the reference voltage Vb, and a negative input terminal of the operational amplifier 602 is coupled to a source of the N-type transistor M7. Moreover, a gate and a drain of the P-type transistor Q4 are coupled to each other, the drain of the P-type transistor Q4 is coupled to a drain of the N-type transistor M7, and a source of the P-type transistor Q4 is coupled to a power voltage VDD. In addition, a gate of the P-type transistor Q5 is coupled to the gate of the P-type transistor Q4, a source of the P-type transistor Q5 is coupled to the power voltage VDD, and a drain of the P-type transistor Q5 is coupled to the switch SW1 and the resistor R1. The capacitor element 604 is coupled between the buffer 606 and the operational amplifier 602, and the buffer 606 is further coupled to a common node of the current source IA1 and the resistor R3. The resistor R3 is coupled between the current source IA1 and the ground.

A cross voltage of the resistor R3 is equal to the output voltage Vout of the reference current generation circuit 500 in the reset mode, and the user can achieve such setting by suitably adjusting a current value of a current provided by the current source IA1 or a resistance of the resistor R3. In the present embodiment, the capacitor element 604 and the capacitor element 304 have same capacitor characteristics, though the disclosure is not limited thereto. Moreover, the capacitor element 604 of the present embodiment is composed of a P-type low voltage transistor LP2, where a gate of the P-type low voltage transistor LP2 is coupled to the buffer 606, and a drain, a source and a bulk of the P-type low voltage transistor LP2 are coupled to the negative input terminal of the operational amplifier 602.

As shown in FIG. 6, the operational amplifier 602 duplicates the reference voltage Vb to a common node between the resistor R2 and the N-type transistor M7 through a negative feedback manner. Since the voltage on the common node between the resistor R2 and the N-type transistor M7 is equal to the reference voltage Vb, and a voltage on the common node between the resistor R3 and the current source IA1 is equal to the output voltage Vout of the reference current generation circuit in the reset mode, a cross voltage of the capacitor element 604 is the same to a cross voltage of the capacitor element 304 when the reference current generation circuit is in the reset mode, and since the capacitor element 604 and the capacitor element 304 have the same capacitor characteristics, a leakage current Ik1 flowing through the capacitor element 604 is equal to a leakage current flowing through the capacitor element 304.

In this way, a current flowing through the N-type transistor M7 and the P-type transistor Q4 is equal to a current value of a current Ib1 plus a current value of the leakage current Ik1, so that a current value of the operating current Iint1 output by the P-type transistor Q5 is equal to the current value of the current Ib1 plus the current value of the leakage current Ik1. Since the leakage current flowing through the capacitor element 304 can be compensated by a current component of the leakage current Ik1, the voltage value of the output voltage Vout is not influenced by the leakage current of the capacitor element 304, and accuracy of the reference current Iout generated by the reference current generation circuit can be maintained.

Similarly, the operating current Iint2 provided by the operating current generation unit 204 can also be generated by the circuit structure of the operating current generation circuit 204A of FIG. 6, i.e. the operating current generation unit 204 further includes another circuit comprising a circuit structure the same with that of the operating current generation circuit 204A, which is used to generate the operating current Iint2 to eliminate the leakage current effect of the capacitor element 304. The drain of the P-type transistor Q5 is coupled to the switch SW2 and the output stage 210, and another slight modification is that the cross voltage of the resistor R3 is set according to the output voltage Vout of the reference current generation circuit in the reset mode and the comparator voltage Vr, so as to effectively compensate the leakage current of the capacitor element 304. For example, the cross voltage of the resistor R3 can be designed to be equal to an average of the output voltage Vout of the reference current generation circuit in the reset mode and the comparator voltage Vr, though the disclosure is not limited thereto.

It should be noticed that when the output stage 210 is controlled by the enable signal EN1 to output the reference current Iout, in order to avoid the current component in the operating current Iint2 generated by the current generation circuit that is used for compensating the leakage current effect of the capacitor element 304 from influencing the accuracy of the reference current Tout, when the output stage 210 outputs the reference current Iout, the buffer 606 is disabled by a disable signal DE1.

Figure 7:
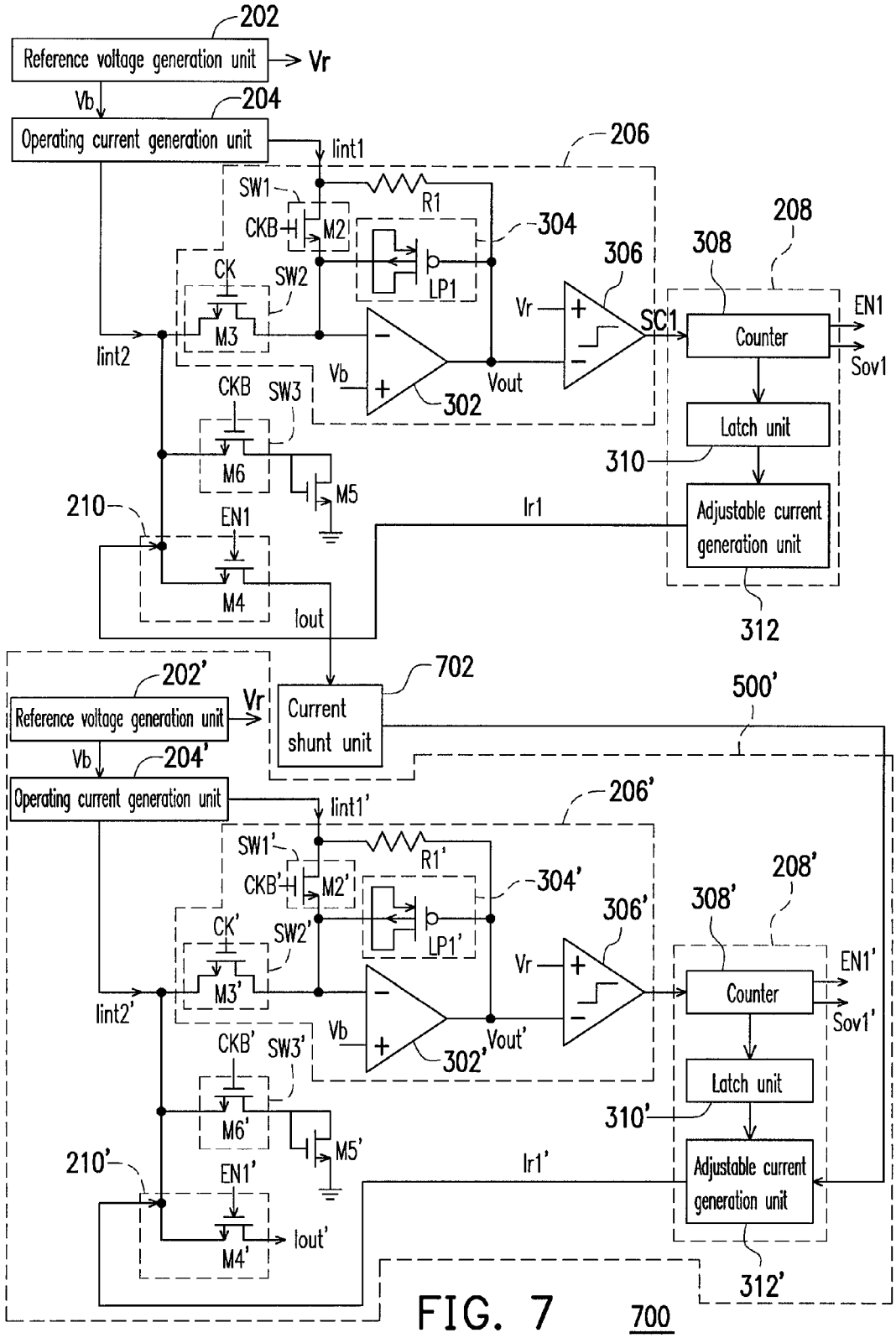
FIG. 7 is a schematic diagram of a reference current generation circuit according to a third embodiment of the disclosure.

FIG. 7 is a schematic diagram of a reference current generation circuit according to a third embodiment of the disclosure. Referring to FIG. 7, a difference between the reference current generation circuit 700 of the present embodiment and the reference current generation circuit 500 of FIG. 5 is that the reference current generation circuit 700 further includes a current shunt unit 702 and a reference current adjusting circuit 500'. The current shunt unit 702 is coupled to the output stage 210 and the reference current adjusting circuit 500'. The current shunt unit 702 receives the reference current Iout to generate a plurality of shunt currents, i.e. the current shunt unit 702 shunts the reference current Iout output by the output stage 210 to output a plurality of the shunt currents.

The reference current adjusting circuit 500' has a circuit structure the same with that of the reference current generation circuit 500. As shown in FIG. 7, the reference current adjusting circuit 500' includes a reference voltage generation unit 202', an operation current generation unit 204', a comparison module 206', an adjustment module 208' and an output stage 210', where the components comprising similar referential numbers with that of the components in the reference current generation circuit 500 have the same functions or characteristics. A difference between the reference current adjusting circuit 500' and the reference current generation circuit 500 is that an adjustable current generation unit 312' in the adjustment module 208' adjusts an output adjusting current Ir1' according to the shunt currents output by the current shunt unit 702. Namely, the adjustable current generation unit 312' selects to output at least one shunt current to serve as the adjusting current Ir1' according to the count value of the counter 308', where the shunt current is taken as a part of the reference current Iout', so as to adjust a current value of the reference current Iout'. Since the shunt currents come from the reference current Ir1 of the reference current generation circuit 500, which has been adjusted by the reference current generation circuit 500, by using the shunt currents as adjusting units of the reference current, the reference current Iout' output by the reference current adjusting circuit 500' is more accurate compared to the reference current Iout.

Figure 8:
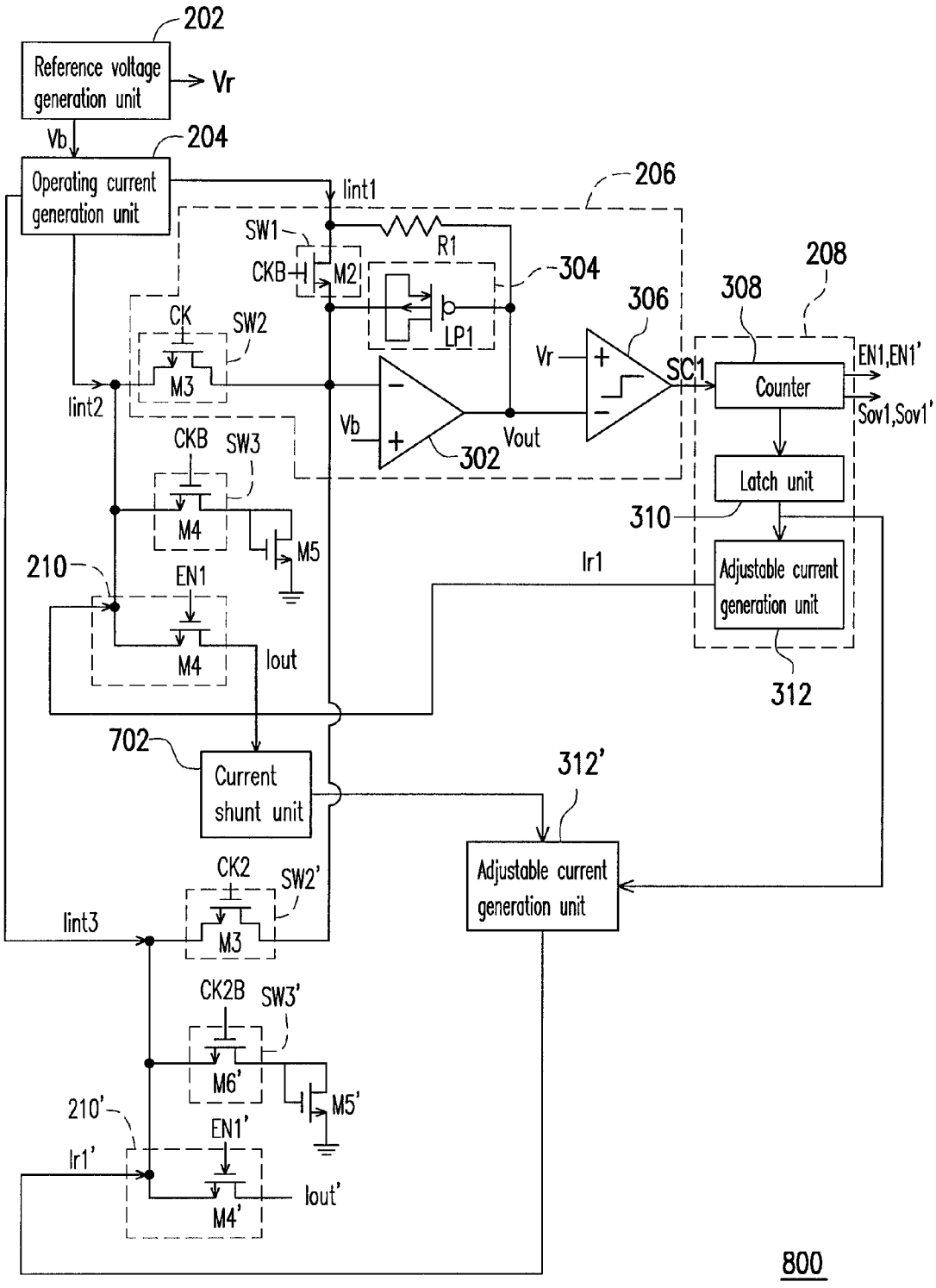
FIG. 8 is a schematic diagram of a reference current generation circuit according to a fourth embodiment of the disclosure.
Figure 9:
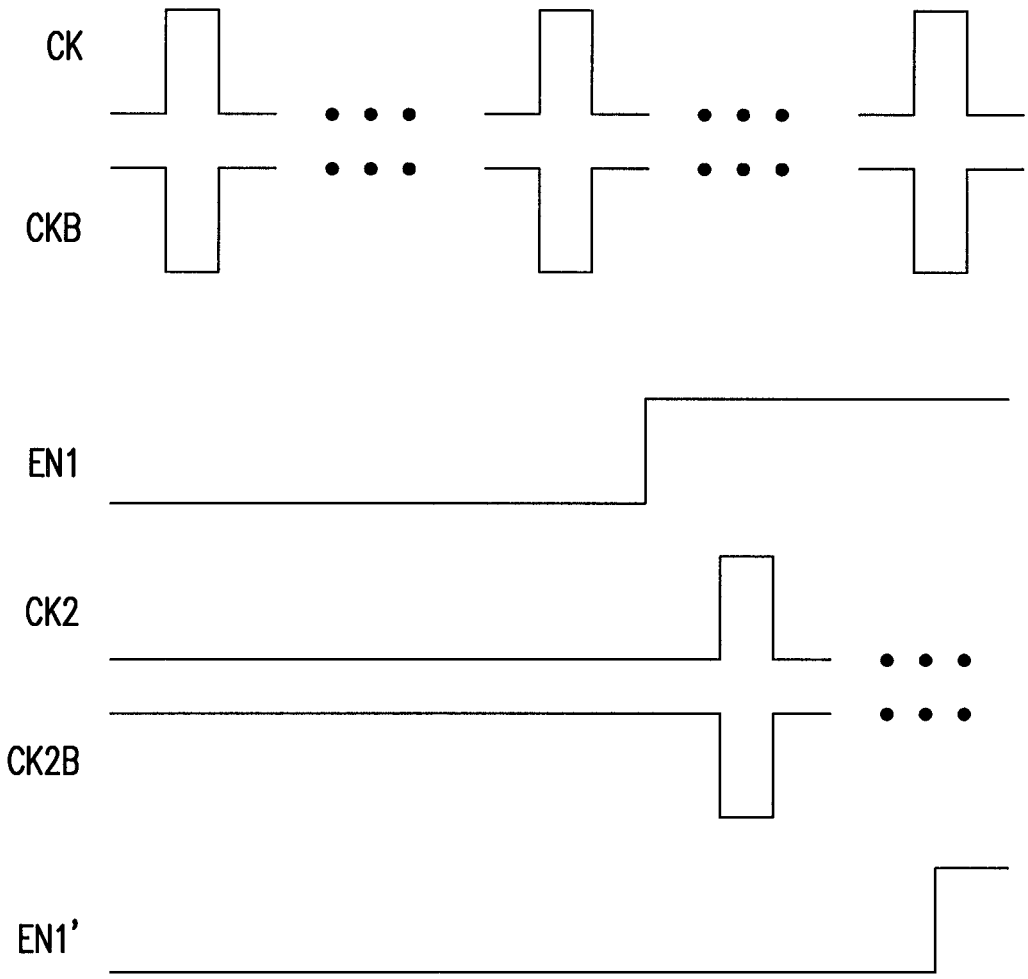
FIG. 9 is a waveform diagram of a part of signals of the reference current generation circuit of FIG. 7.

FIG. 8 is a schematic diagram of a reference current generation circuit according to a fourth embodiment of the disclosure. FIG. 9 is a waveform diagram of a part of signals of the reference current generation circuit of FIG. 7. Referring to FIG. 8 and FIG. 9, the reference current generation circuit 800 is a circuit simplification result of the reference current generation circuit 700 of FIG. 7, and since the reference current generation circuit 500 and the reference current adjusting circuit 500' of FIG. 7 operate according to clocks signals comprising different enable periods (shown in FIG. 9), a part of circuit components of the reference current generation circuit 700 can be omitted. As shown in FIG. 8, compared to the reference current generation circuit 500 of FIG. 5, the reference current generation circuit 800 of the present embodiment further includes a current shunt unit 702, an adjustable current generation unit 312', switches SW2' and SW3', and an output stage 210', where the switches SW2' and SW3' and the output stage 210' are respectively controlled by clock signals CK2 and CK2B and an enable signal EN1'. In this way, by sharing a part of the components, not only an accurate reference current Iout' is obtained, but also the production cost of the reference current generation circuit is reduced.

In summary, in the disclosure, the current generated according to the bandgap voltage is not directly used as the reference current, but the comparison module, the adjustment module and the output stage are used to adjust the reference current according to the operating current (which is generated according to the bandgap voltage), by which the reference voltage is generated without using an external resistor, so as to effectively decrease the production cost. Moreover, one or multiple adjustments can be performed according to the adjusted reference current, so as to further enhance the accuracy of the reference current.

It will be apparent to those skilled in the art that various modifications and variations can be made to the structure of the disclosure without departing from the scope or spirit of the disclosure. In view of the foregoing, it is intended that the disclosure cover modifications and variations of this disclosure provided they fall within the scope of the following claims and their equivalents.

What is claimed is:

1. A reference current generation circuit, comprising:

a reference voltage generation unit, configured to generate a reference voltage and a comparison voltage;

an operating current generation unit, configured to receive the reference voltage to generate a first operating current and a second operating current;

a comparison module, configured to generate an output voltage according to the reference voltage, the first operating current and the second operating current, and comparing the output voltage with the comparison voltage to generate a comparison signal for outputting an adjustment module, configured to receive the comparison signal to generate a first enable signal and an adjusting current; and a first output stage, configured to receive the adjusting current, the first enable signal and the second operating current, and outputting a first reference current.

2. The reference current generation circuit as claimed in claim 1, wherein the comparison module comprises:

a first operational amplifier, comprising a positive input terminal coupled to the reference voltage, and an output terminal outputting the output voltage;

a first switch, coupled between the operating current generation unit and a negative input terminal of the first operational amplifier, and receiving the first operating current, wherein a conduction state of the first switch is controlled by a first clock signal;

a second switch, coupled to the negative input terminal of the first operational amplifier and the operating current generation unit, and receiving the first reference current, wherein a conduction state of the second switch is controlled by a second clock signal, and the first clock signal is inverted to the second clock signal;

a first resistor, coupled to the first switch and an output terminal of the first operational amplifier;

a first capacitor element, coupled to the negative input terminal and the output terminal of the first operational amplifier; and a comparator, comprising a positive input terminal coupled to the comparison voltage, a negative input terminal coupled to the output terminal of the first operational amplifier, and outputting the comparison signal.

3. The reference current generation circuit as claimed in claim 2, wherein the first capacitor element is composed of a P-type low voltage transistor.

4. The reference current generation circuit as claimed in claim 2, wherein the comparison module further comprises:

a third switch, comprising one terminal coupled to the operating current generation unit, wherein a conduction state of the third switch is controlled by the first clock signal; and an N-type transistor, comprising a gate and a drain coupled to another terminal of the third switch, and a source coupled to ground.

5. The reference current generation circuit as claimed in claim 2, wherein the operating current generation unit comprises:

a second operational amplifier, comprising a positive input terminal receiving the reference voltage;

an N-type transistor, comprising a gate coupled to an output terminal of the second operational amplifier, and a source coupled to a negative input terminal of the second operational amplifier;

a first P-type transistor, comprising a gate and a drain coupled to a drain of the N-type transistor, and a source coupled to a power voltage;

a second P-type transistor, comprising a gate coupled to the gate of the first P-type transistor, a source coupled to the power voltage, and a drain coupled to the first switch;

a second resistor, coupled between the negative input terminal of the second operational amplifier and the ground;

a second capacitor element, comprising one terminal coupled to the negative input terminal of the second operational amplifier;

a buffer, coupled to another terminal of the second capacitor element;

a current source, coupled to the buffer; and a third resistor, coupled to the current source and the ground.

6. The reference current generation circuit as claimed in claim 5, wherein the second capacitor element is composed of a P-type low voltage transistor.

7. The reference current generation circuit as claimed in claim 5, wherein when the first output stage outputs the first reference current, the buffer is disabled by a disable signal.

8. The reference current generation circuit as claimed in claim 7, wherein a cross voltage of the third resistor is equal to an average of the output voltage and the comparison voltage.

9. The reference current generation circuit as claimed in claim 2, wherein when the first clock signal has a high voltage level, the reference current generation circuit is in a reset mode, and when the first clock signal has a low voltage level, the reference current generation circuit is in a charge mode.

10. The reference current generation circuit as claimed in claim 9, wherein the adjustment module comprises:

a counter, coupled to the comparison module, and outputting a count value or the first enable signal according to the comparison signal in the charge mode;

a latch unit, coupled to the counter, and temporarily storing the count value; and a first adjustable current generation unit, outputting the adjusting current according to the count value.

11. The reference current generation circuit as claimed in claim 10, wherein when the output voltage is greater than the comparison voltage, the counter outputs the count value, and when the output voltage is smaller than the comparison voltage, the counter outputs the first enable signal.

12. The reference current generation circuit as claimed in claim 10, wherein when the counter counts to a first threshold value, the counter further outputs a first overflow signal, and the first adjustable current generation unit adjusts the adjusting current according to the first overflow signal.

13. The reference current generation circuit as claimed in claim 12, wherein the operating current generation unit further outputs a third operating current, the counter further outputs a second enable signal according to the comparison signal, and the reference current generation circuit further comprises:

a current shunt unit, coupled to the first output stage, and receiving the first reference current to generate a plurality of shunt currents;

a second adjustable current generation unit, coupled to the current shunt unit, and outputting at least the shunt currents according to the count value;

a third switch, comprising one terminal coupled to the negative input terminal of the first operational amplifier, and another terminal coupled to the operating current generation unit and the second adjustable current generation unit for receiving the shunt currents and the third operating current, wherein a conduction state of the third switch is controlled by a third clock signal; and a second output stage, coupled to the operating current generation unit and the second adjustable current generation unit, receiving the shunt current and the third operating current, and outputting the second reference current according to the second enable signal.

14. The reference current generation circuit as claimed in claim 13, wherein when the counter counts to a second threshold value, the counter further outputs a second overflow signal, and the second adjustable current generation unit outputs the shunt currents to adjust the adjusting current according to the second overflow signal.

15. The reference current generation circuit as claimed in claim 13, wherein the reference current generation circuit further comprises:

a fourth switch, comprising one terminal coupled to the operating current generation unit, wherein a conduction state of the fourth switch is controlled by a fourth clock signal, and the third clock signal is inverted to the fourth clock signal; and an N-type transistor, comprising a gate coupled to a drain of the N-type transistor, and a source coupled to the ground.

* * * * *